US011827406B1

(12) United States Patent
Kampes

(10) Patent No.: US 11,827,406 B1
(45) Date of Patent: Nov. 28, 2023

(54) OPENER FOR A ZIPPER

(71) Applicant: Qraftly Holding B.V., Emmeloord (NL)

(72) Inventor: Marcel Edwin Alexander Kampes, Emmeloord (NL)

(73) Assignee: Qraftly Holding B.V., Emmeloord (NL)

( * ) Notice: Subject to any disclaimer, the term of this patent is extended or adjusted under 35 U.S.C. 154(b) by 0 days.

(21) Appl. No.: 17/738,446

(22) Filed: May 6, 2022

(51) Int. Cl.
*B65B 7/02* (2006.01)

(52) U.S. Cl.
CPC ..... *B65B 7/02* (2013.01)

(58) Field of Classification Search
CPC B65B 7/02; B65B 7/06; B65B 43/465; B65B 51/00; B65B 51/16; B65B 61/188; B65B 51/046
USPC ..... 53/133.4, 139.2, 284.7, 373.2, 375.4; 383/63, 61.2, 7, 78, 209
See application file for complete search history.

(56) References Cited

U.S. PATENT DOCUMENTS 4,727,709 A * 3/1988 Zieke ..... B65B 9/13 53/551
4,744,674 A * 5/1988 Nocek ..... B65D 33/2525 53/410
4,798,041 A * 1/1989 Bentsen ..... B65B 43/267 53/384.1
2004/0123569 A1 7/2004 Jacobsen et al.
2012/0186195 A1* 7/2012 Moeller ..... B65B 67/06 53/373.2
2013/0125508 A1* 5/2013 Honda ..... B65B 39/12 53/268
2018/0022484 A1* 1/2018 Christophel ..... B65B 43/50 53/284.7

FOREIGN PATENT DOCUMENTS

JP 01098414 4/1989

* cited by examiner

*Primary Examiner* — Anna K Kinsaul
*Assistant Examiner* — Veronica Martin
(74) *Attorney, Agent, or Firm* — THE WEBB LAW FIRM

(57) ABSTRACT

The present invention relates to a clamping device for clamping at least part of a zipper. The clamping device includes a base, a head including an upper jaw movably connected to a lower jaw, an arm at one end pivotably connected to the base and at another opposite end pivotably connected to the head; and at least one driving means suitable for pivoting the head with respect to the arm. The upper jaw includes a recession for accommodating at least part of a slider of the zipper. The head is movable from an open position, wherein the upper jaw and the lower jaw are spaced apart, to a closed position, wherein a cavity is formed by the recession and the lower jaw; and the slider is securable within the cavity.

14 Claims, 7 Drawing Sheets

OPENER FOR A ZIPPER

BACKGROUND OF THE INVENTION

Field of the Invention

The present invention relates to a clamping device for clamping at least part of a zipper, a closing system and a method for closing a bag.

Description of Related Art

Zippers have been developed as a convenient structure for attaching two separate sheets of fabric together at the edges of the fabric and are common in many products such as clothing, bags, and tents. A zipper is also known as a zip fastener, clasp locker, or simply a zip.

A zipper has a chain and a slider that runs along the chain. The chain itself is made up out of two rows of elements, such as teeth or coil. The elements of one row of elements are able to interlock with the elements of the other row of elements. A slider runs along the chain and can join or separate the elements of each row, depending on the direction wherein the slider runs. If the elements are separated by the slider, the zipper is opened and if the elements are joined by the slider, the zipper is closed. The chain typically has a single bottom stop and two top stops. The bottom stop usually consist of an insert pin on one row of elements and a retainer box on the other row of elements.

The slider is also referred to as car, comprises a Y-shaped canal for accommodating both rows of elements. A lug, bridge, or crown is situated on top of the slider and functions as an attachment structure for a puller or tab. The puller can be grasped between fingers and thumb to pull the slider back and forth to open or close the zipper.

Zippers are made for conveniently separating or attaching two pieces of fabric, or other flexible sheet-like materials via a human operation. Zippers are frequently used in the postal industry, wherein parcel bags with zippers are filled with postal packages. Automatic packaging lines sort postal packages by destination, and parcels having a destination within a predetermined area are grouped and collected within a bag for convenient transportation. A zipper on the bag is manually closed to retain the parcels inside the bag.

A main reason why closure of postal bags having a zipper is still a human operation is related to the structure of the zipper itself. A zipper is designed to be operated by a human. Zippers are prone to wear out in time. The teeth of zippers wear out after repeated use, leading to zippers wherein the slider is more difficult to pull as compared to new zippers. In addition, the pull or tab can easily be torn off the slider when the zipper ages.

Manual closure of the parcel bags by an employee is an endeavour with a varying rate of success. The filled bags are heavy and shifting of the packages inside the bags frequently leads to packages blocking the slider and preventing the closure of the zipper. A makeshift solution frequently adopted by the responsible personnel is to remove one or a few packages from the bag before closing the zipper. Although effective, this solution is obviously unwanted and leads to lost packages. In addition, this deceptively simple manual task is unwanted from an economic point of view, as employees have to be hired by postal package companies for this task.

As time progresses, a large proportion of package sorting and delivery lines are automated. The closing of bags having a zipper, however stubbornly remains a manual task, which is unreliable and expensive. There is thus a long felt need to improve the reliability of closing bags for postal packages and to lower costs for this operation.

SUMMARY OF THE INVENTION

The invention provides thereto a clamping device for clamping at least part of a zipper, comprising: a base, a head comprising an upper jaw movably connected to a lower jaw, an arm at one end pivotably connected to the base and at another opposite end pivotably connected to the head, and at least one driving means suitable for pivoting the head with respect to the arm. The upper jaw comprises a recession for accommodating at least part of a slider of the zipper. The head is movable from an open position, wherein the upper jaw and the lower jaw are spaced apart, to a closed position, wherein a cavity is formed by the recession and the lower jaw. The slider is securable within the cavity.

The clamping device according to the present invention benefits from being able to clamp a slider from both the front and the back side of a zipper. The recession ensures that the slider is accommodated therein. The slider is secured by the clamping forces provided by the upper and lower jaws that act on a front and back side of the slider. The jaws hold the slider firmly in place, while contact with the elements or parts of the zipper other than the slider either absent or minimized. The recession is preferably dimensioned such that a part of the slider fits within the recession. In particular, the bridge or crown of the slider can be accommodated in the recession, as this is a part of the slider that protrudes substantially from the slider. In addition, the bridge is an integral part of the slider and has a high structural integrity. Even when the pull is no longer attached to the bridge, the bridge is most often still intact. As such, the bridge forms a structure that can reliably be accommodated within the recession.

The base and arm of the clamping device enable the head to be positioned with respect to a zipper of a postal bag, such that the slider of the zipper is located between the upper jaw and the lower jaw. The driving means may pivot the head with respect to the arm to move the head in the correct position. Once the jaws of the head are in the correct position, the head can move from the open position to the closed position to secure the slider.

Preferably, the at least one driving means comprises a first hydraulic piston and a second hydraulic piston, wherein the first hydraulic piston is arranged to pivot the head with respect to the arm and wherein the second hydraulic piston is arranged for moving the head back and forth between the open position and the closed position.

Hydraulic pistons allow for reliable and accurate movement of the head with respect to the arm and movement of the head between the open and closed position. Additionally or alternatively, motors, such as servomotors can be used to move the jaws with respect to each other or to move the head with respect to the arm.

In a preferred embodiment, the base comprises a motor for arranged to pivot the arm with respect to the base. This further improves the accuracy and freedom of movement of the clamping device with respect to the slider of the zipper. Advantageously, this allows the distance between the base and the slider to be increased, while the upper jaw and the lower jaw of the head can still be positioned above and below the slider, respectively. The range or reach of the head with respect to the base is thus further increased. As an alternative for a motor, the base can comprise one or more hydraulic pistons.

Preferably, the upper jaw is tapered. This allows the upper jaw to effectively separate sheeting that can be present of top of each row of elements. Such sheeting can be made of flexible fabric and is present to protect the chain from debris lodging itself between the teeth. When the elements are interlocked, the closed zippers is covered by two sheets having edges that align along and over the chain. The upper jaw is able to effectively separate such sheeting prior to clamping the slider between the upper and lower jaw.

The upper jaw can be tapered towards a first outer end of the upper jaw. Additionally or alternatively the upper jaw may comprise an upper surface and a lower surface connected to each other by a first side and a second side, wherein the first side joins the second side at an outer edge. The outer edge may be a first outer end of the upper jaw opposite a second outer end. The second outer end may be movably connected to the head.

The edge where the first side and the second side join may be a straight edge that is oriented in a direction substantially parallel to a movement direction of the upper jaw. This edge can be blunt and corners where the edge meets the lower and upper surfaces of the upper jaw, may be rounded.

Preferably, the upper jaw comprises an outer edge running in a direction from the lower jaw to the upper jaw; wherein the outer edge is at least partly chamfered. This prevents the zipper from being damaged when the head is positioned and further facilitates in deflecting sheeting that covers the zipper prior to clamping the slider.

In another aspect, the invention relates to a head for a clamping device comprising an upper jaw movably connected to a lower jaw. The upper jaw comprises a recession for accommodating at least part of a slider of the zipper. The head is movable from an open position, wherein the upper jaw and the lower jaw are spaced apart, to a closed position, wherein a cavity is formed by the recession and the lower jaw, and the slider is securable within the cavity. Preferably, the upper jaw of this head is tapered and comprises an outer edge running in a direction from the lower jaw to the upper jaw; wherein the outer edge is at least partly chamfered.

Advantageously, the outer edge may comprise a first chamfered part, a second chamfered part, and an intermediate part between the first chamfered part and the second chamfered part that is not chamfered. The intermediate part of the outer edge of the upper jaw can be easily pushed between two adjacent edges of sheeting covering the zipper as this intermediate part is relatively sharp as compared to the first and second chamfered parts.

The first chamfered part may extend from the upper corner, formed by the upper surface of the upper jaw and the outer edge, up to approximately one third to one half of the edge, in a direction from the upper surface towards the lower surface of the upper jaw. In particular this first chamfered part effectively rounds this upper corner. As such, the rounded upper corner is particularly suited to deflect sheeting covering the zipper after the intermediate part of the edge has been pushed between the two adjacent edges of sheeting.

In a preferred embodiment, the first chamfered part is a corner chamfered part and/or the second chamfered part is a corner chamfered part. A corner chamfered part is a rounded corner wherein the surface of this rounded corner is substantially flat when viewing the corner from a first direction, while this surface is bent or rounded when viewing the surface from another second direction, wherein the second direction is perpendicular to the first direction.

The second chamfered part may extend from the lower corner, formed by the lower surface of the upper jaw and the outer edge, up to approximately one half to two thirds of the outer edge, in a direction from the lower surface towards the upper surface of the upper jaw. In particular this second chamfered part effectively rounds this lower corner. As such, the second chamfered part and/or the first chamfered part may be corner chamfered parts.

At least a section of the second chamfered part may comprise a substantially flat surface. In particular this substantially flat surface may form a part of the lower corner of the upper jaw. The clamping device can be oriented such that the lower surface of the upper jaw is at an oblique angle with respect to the direction wherein the zipper extends, while the substantially flat surface is oriented substantially parallel to the front side of the zipper, i.e. at the side of the zipper where the bridge or crown of the slider is located. As such, the upper jaw is able to move along the chain of the zipper, while remaining as close as possible to the chain. This orientation of the upper jaw is advantageous to deflect the sheeting covering the zipper.

In a preferred embodiment an angle of a corner mutually enclosed by a first side and a second side of the upper jaw ranges between 40 and 120 degrees, preferably between 50 and 110 degrees, more preferably between 60 and 100 degrees, most preferably between 70 and 90 degrees. The edge where the first side and second side adjoin is the outer edge of the upper jaw. The inventors have found that this angle is particularly suited to effectively deflect sheeting covering the zipper.

In another embodiment, the recession is a groove extending from the second outer end towards the first outer end of the upper jaw. A length of the groove is smaller than a length of the second outer end to the first outer end. In particular, the groove may extend all the way towards the second outer end of the upper jaw. The upper jaw is movably connected to the lower jaw. When viewed from a direction from the second outer end towards the first outer end of the upper jaw, a cross section of the groove is visible. When viewed from an opposite direction, i.e. from a direction from the first outer end to the second outer end, this cross section is invisible, as the groove does not extend all the way to the first outer end. As such, the clamping device is capable of reliable and accurate clamping of the slider independent of the exact position of the slider along the chain.

The lower jaw may have a rounded tip. The tip of the lower jaw is a part of the lower jaw that is located furthest from the point where the upper and lower jaw are movably connected. A rounded tip prevents damage to the bag resulting from bringing the lower jaw into position behind the slider at the backside of the zipper. In addition, the rounded tip facilitates positioning of the lower jaw.

The recession may have a depth between 1 to 10 mm, preferably between 2 to 9 mm, more preferably between 3 to 8 mm, most preferably between 4 to 6 mm. This depth is particularly suited to accommodate a slider of a zipper, while preventing other parts of the zipper being clamped between the upper and lower jaw. A depth of the recession is in this case defined as a distance wherein the recession protrudes inwardly in the upper jaw in a direction from the lower surface to the upper surface of the upper jaw. In particular the depth is about 5 mm, such as 4.7 to 5.3 mm.

In another aspect, the invention relates to a closing system, comprising: a clamping device and a gripping arm for gripping a bag comprising a zipper, wherein the clamping device and the gripping arm are movable in opposite directions along the length of the zipper. The clamping device may be a clamping device as outlined above. Moving the gripping arm and the clamping device in opposite directions, after the bag has been grasped by the gripping arm and the slider has been clamped by the clamping device, allows the zipper to be closed automatically.

Preferably, the closing system comprises controlling means for measuring the resistance of the slider sliding along the chain of the zipper. The speed wherein the gripping arm and the clamping device moved in opposite directions can be adjusted accordingly. This prevents the zipper and bag from damage occurring as a result of a rough or stiff zipper and a blocked slider.

In a preferred embodiment the closing system comprises a bag opener for opening the bag, wherein the bag opener comprises a plurality of suction cups for attaching to at least one ring structure of the bag. Bags for postal packages are typically made of fabric that is not airtight. As such, reliable grasping of both sides of a bag for opening the bag presents an issue. The types of bags that are suitable to use in a closing system according to the invention typically contain four rings. Two rings are located on either side of the bag such that the rings form a through hole from one side of the bag to the other. These through holes are convenient for hanging the bags on a pair of pins or rails when the bags are to be filled or stored.

These rings can be the only part of the bags that are airtight. As such, the plurality of suction cups represent a reliable and robust part of the closing system to open the bag prior to insertion and positioning of the clamping device.

Preferably the closing system comprises a transport means for transporting the bag to the clamping device and the gripping arm, wherein the transport means comprises a pair of rails. These rails may extend through the aforementioned rings and guide the bags towards the bag opener. The rails may be embodied as elongated pins or long shafts. Different types of transportation means to transport the bags along the rails are envisagable such as a push or pull device that grabs a bag and pulls it towards the bag opener along the rails.

In another aspect, the invention relates to a method for closing a bag comprising a zipper, comprising: Opening the bag, clamping a slider of the zipper with a clamping device, gripping the bag with a gripping device, and moving the gripping device and the clamping device in opposite directions along the length of the zipper to close the bag.

Preferably, the step of opening the bag comprises attaching a first plurality of suction cups to at least one first ring structure of the bag on one side of the bag and attaching a second plurality of suction cups to at least one second ring structure of the bag on an opposite side of the bag; and pulling the first plurality of suction cups and the second plurality of suction cups away from each other in opposite directions.

BRIEF DESCRIPTION OF THE DRAWINGS

The present invention will be further elucidated on the basis of the non-limitative exemplary embodiments shown in the following figures, wherein.

DESCRIPTION OF THE INVENTION

Similar reference numbers are used to indicate similar parts across the different figures.

Figure 1:
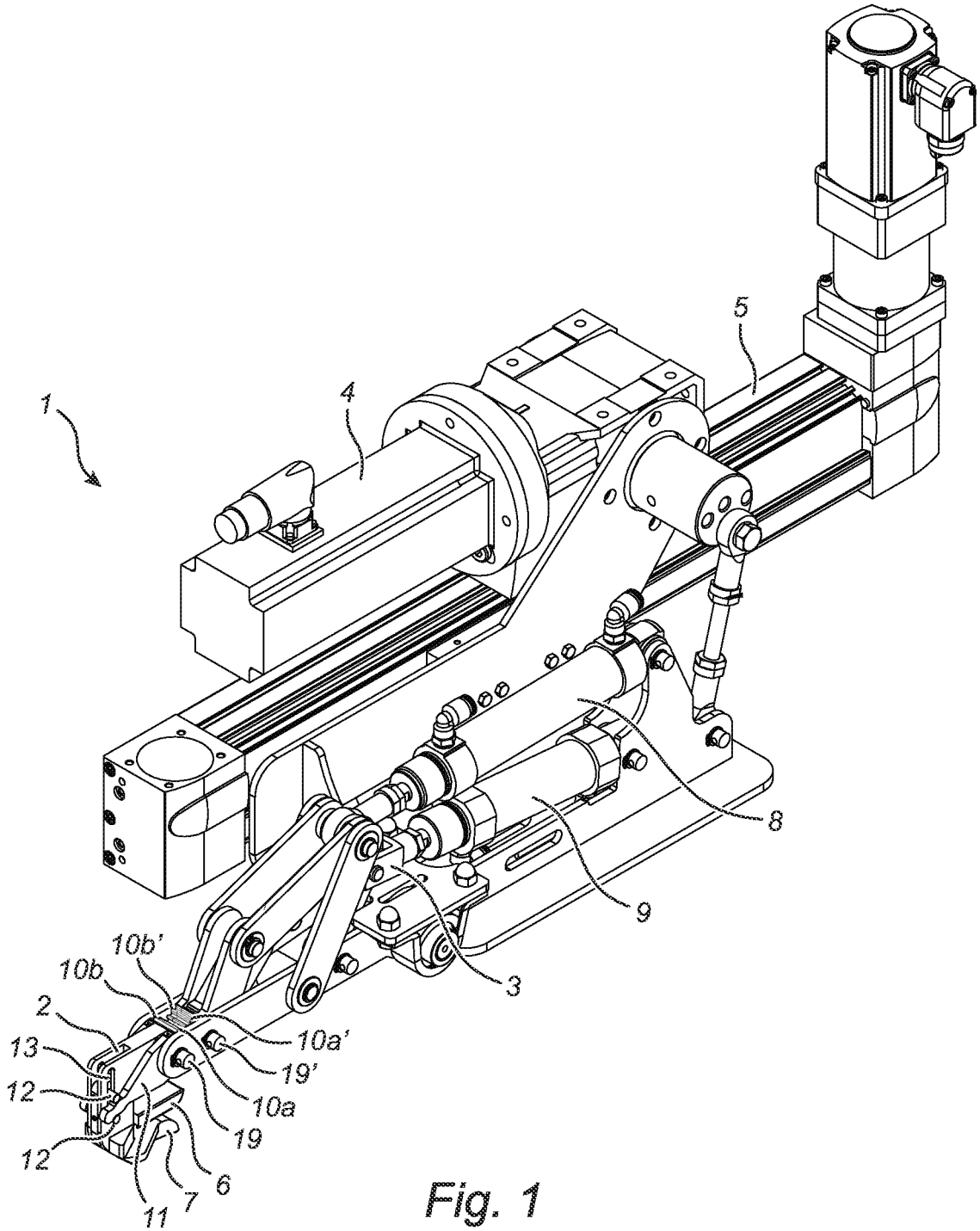
FIG. 1 shows a perspective view of a clamping device according to the invention.

A clamping device 1 according to the invention is shown in FIG. 1. A head 2 is pivotably attached to a mechanical arm 3, the arm comprising a pair of pistons and several rotatable connections. The mechanical arm 3 aids in positioning and orienting the clamping device 1 relative to a bag having a zipper (not shown). The mechanical arm 3 is attached to a servomotor 4 for pivoting the arm. The servomotor 4 is movable along a rail 5. The clamping device 1 includes base 20.

Figure 2:
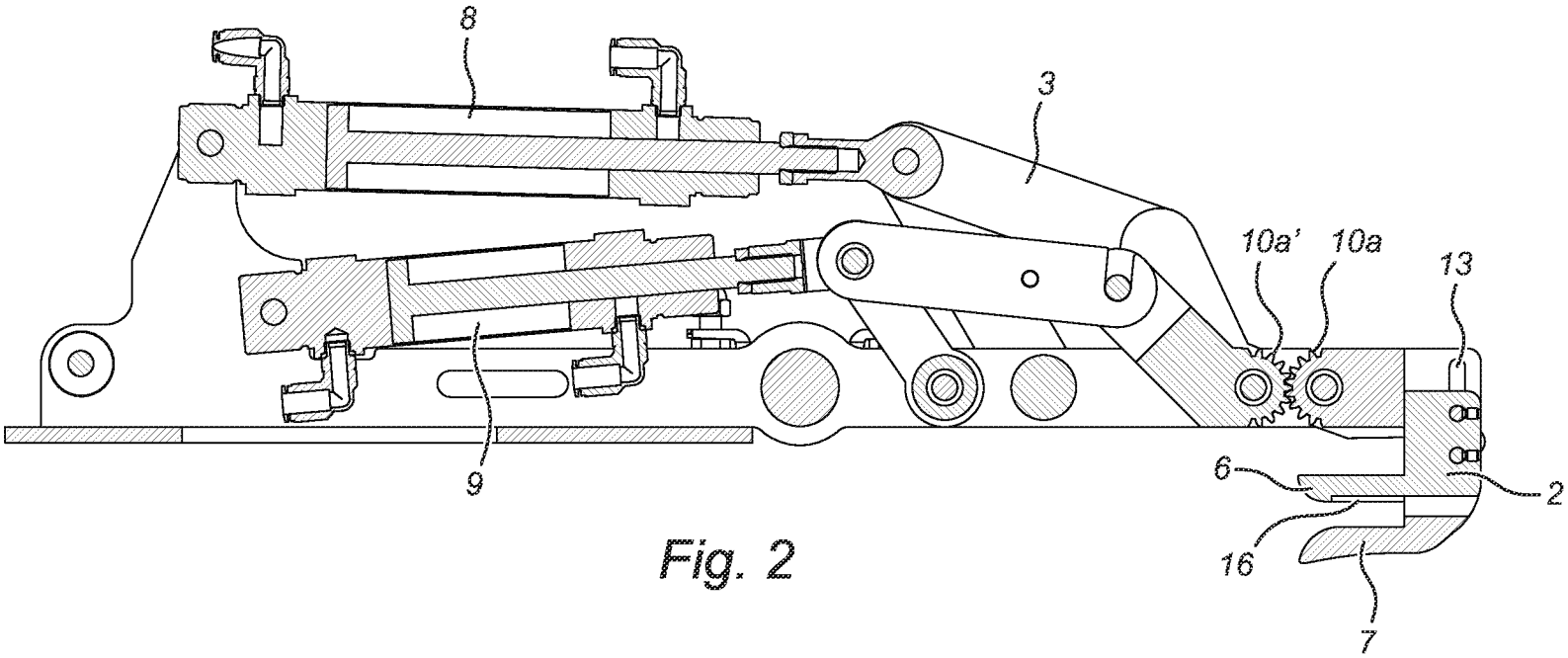
FIG. 2 shows a side view of an embodiment of the arm and the head of the clamping device of FIG. 1, FIGS. 3*a*-3*c* show a perspective and side views of an embodiment of a head according to the invention.

An expanding movement of the upper piston 8 as shown in FIGS. 1 and 2 is transferred via two rotatable connections and a pair of outer sprockets to the upper jaw 6 of the clamping device 1. The outer pairs of sprockets 10*b*, 10*b*' are rotatable independent of the inner pair of sprockets 10*a*, 10*a*'. Both inner and outer sprockets 10*a*, 10*b* and 10*a*', 10*b*' are rotatable along shared axes 19, 19'. Two levers 11, that are at one end connected to the outer sprockets 10*b* and at another end movably positioned between a pair of pins 12, enable the upper jaw 6 of the head 2 to move away from the lower jaw 7 by the expansion of the piston 8. The pair of pins 12 protrude from either side of the clamping device and are rigidly attached to the upper jaw 6. The pins are movable in two parallel elongated slots 13. These slots are part of the head 2. Extension of the upper piston 8 results in opening of the jaws 6, 7 of the head 2 via the rotatable connections, sprockets, pins and slots. Likewise, retraction of the piston 8 causes the upper jaw 6 to move towards the lower jaw 7, thereby moving the head 2 to the closed position.

The lower piston 9, as shown in FIGS. 1 and 2 is connected to an inner sprocket 10*a*'. Expanding or retracting motion of the lower piston 9 is transferred via a first inner sprocket 10*a*' to another inner sprocket 10*a* that is an integral part of the head 2 of the clamping device 1. The motion of the lower piston 9 thus causes the head 2 to pivot with respect to the mechanical arm 3.

Figure 3A:
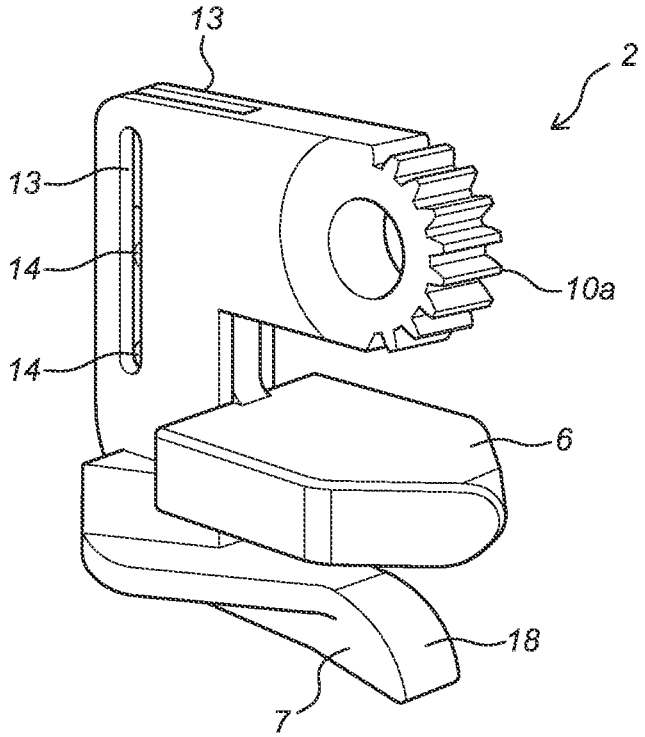
Figure 3B:
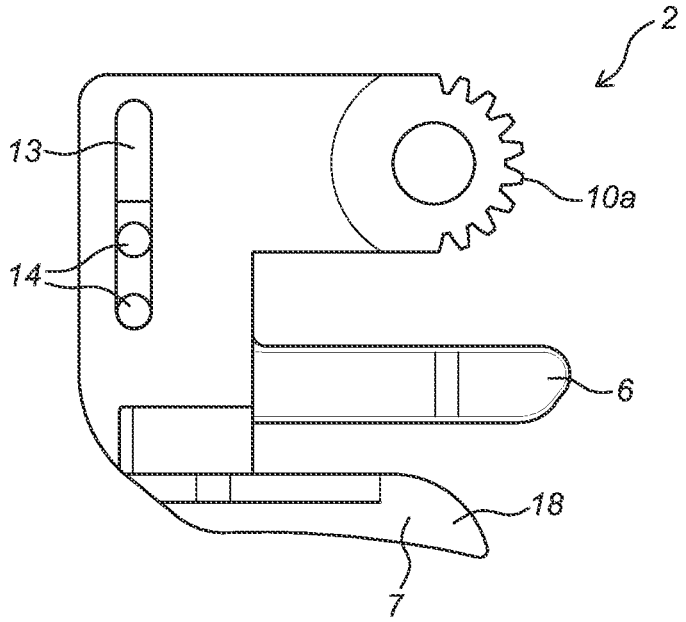
Figure 3C:
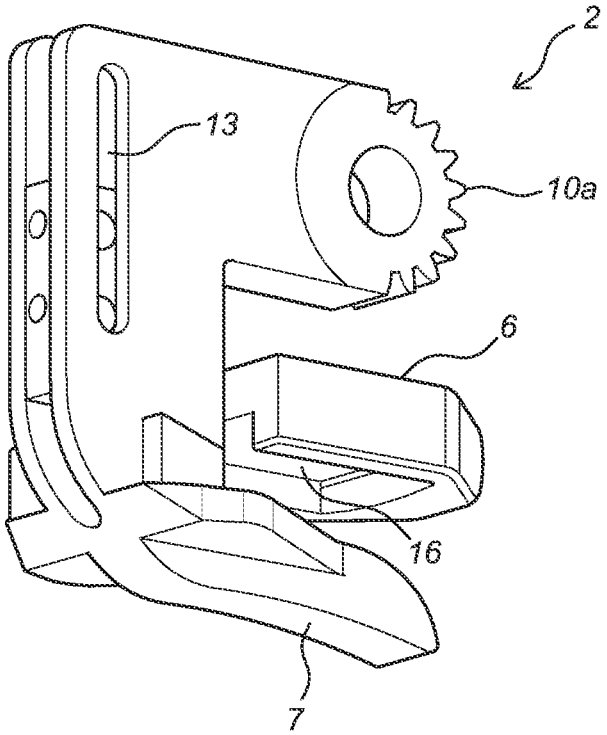

A detailed view of an embodiment of the head 2 is given in FIGS. 3*a*-3*c*. FIG. 3*a* shows a perspective view, such that the upper jaw 6 is visible from above. FIG. 3*b* shows a side view of the embodiment shown and FIG. 3*c* shows a perspective view, such that the upper jaw 6 is visible from below. The head 2 comprises an upper and a lower jaw 6, 7. Both the upper and the lower jaw have curved edges specifically shaped to facilitate positioning of the head 2 with respect to a postal bag. In operation the upper jaw 6 is positioned above a slider of a zipper when the zipper is in horizontal position, i.e. the upper jaw 6 is positioned on the side of the slider that contains the bridge or crown. The lower jaw 7 is positioned under the slider, i.e. on the side of the slider that does not contain the bridge. When both jaws 6, 7 are in position, the upper jaw 6 is moved towards the lower jaw 7 and the slider of the zipper is securely clamped between the upper and lower jaw 6, 7. When the slider of the zipper is secured, the slider of the zipper is accommodated in the cavity formed by the recession 16 and the lower jaw 7. The head 2 is then in the closed position.

FIGS. 3*a*-3*c* show how the upper and lower jaw, 6, 7, fit together to form the head 2. The head 2 can be made of any suitable metal or alloy, such as steel. But other materials, such as plastics are also envisagable.

Figure 4A:
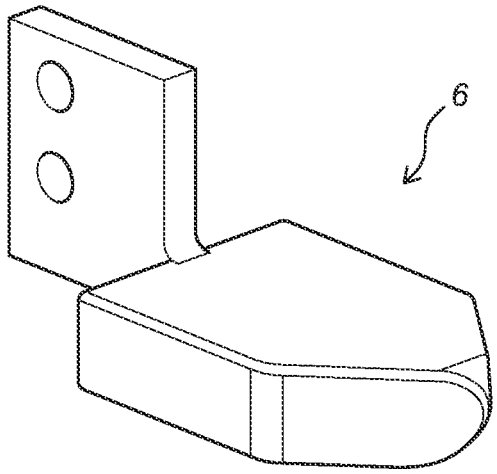
FIGS. 4*a*-4*b* show perspective views of the upper jaw of the head of FIGS. 3*a*-3*c*, FIGS. 5*a*-5*b* show perspective views of the lower jaw of the head of FIGS. 3*a*-3*c*.
Figure 4B:
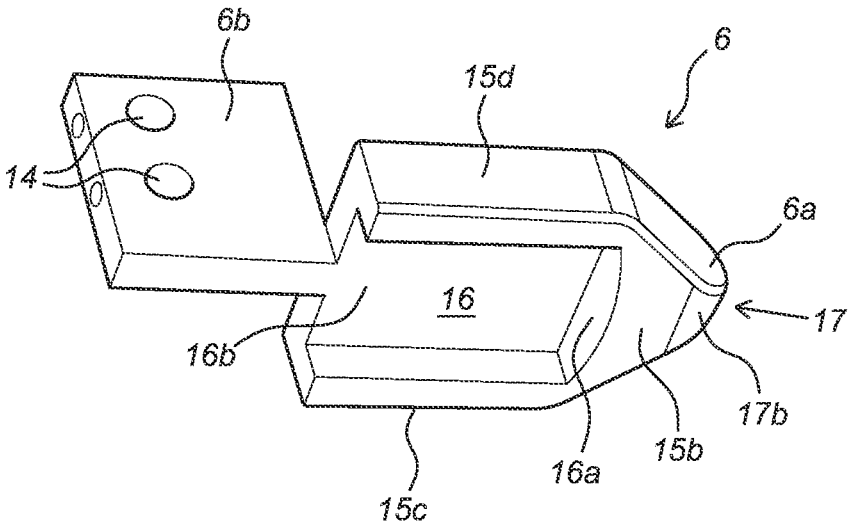
Figure 5A:
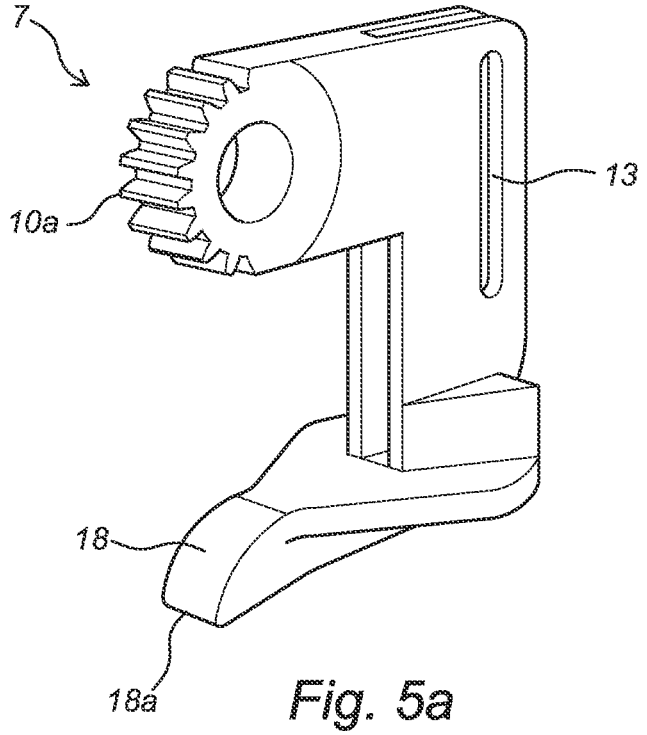
Figure 5B:
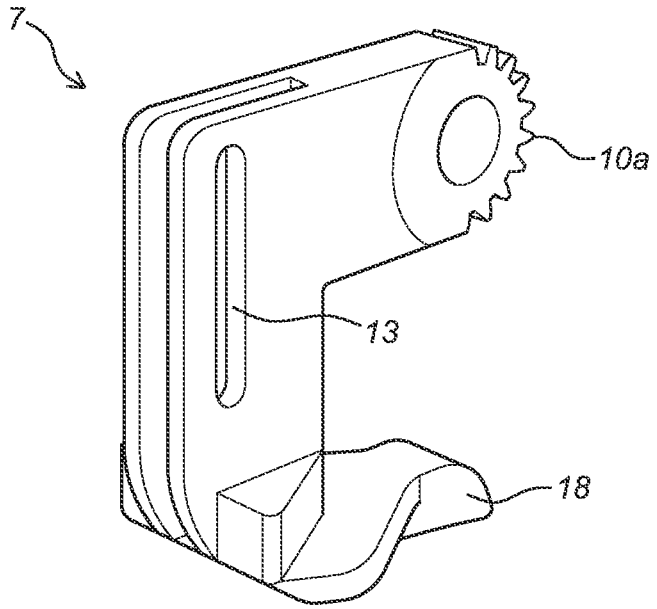

FIGS. 4*a* and 4*b* show detailed views of the upper jaw 6 from the embodiment of the head shown in FIGS. 3*a*-3*c*. The upper jaw 6 is tapered towards a first outer end 6*a* of the upper jaw. At an opposite outer end 6*b*, the upper jaw comprises a substantially rectangular section. This section contains two holes 14 wherein pins or bolts can be inserted for positioning in complementary elongated slots 13 of the lower jaw 7 as shown in FIGS. 5*a* and 5*b*.

The upper jaw 6 is visible from below in FIG. 4*b*. The bottom of the upper jaw comprises a substantial rectangular recession 16 to accommodate a slider of a zipper. A curved side of the recession 16*a*, located close to the first outer end 6*a* of the upper jaw, functions as a retainer for the slider. In use, the upper jaw 6 moves in a direction B from the first outer end 6*a* towards the opposite outer end 6*b*. In said movement, the substantially rectangular recession 16 retains the slider of a zipper for between the upper and lower jaw. The recession 16 is thus open at one end 16*b* opposite the curved side 16*a*. The substantially rectangular shape of the recession 16, and the open configuration at one end 16*b*, ensure that the exact position of the slider along the elements of the zipper relative to the recession of the upper jaw 6 is not critical. The open configuration and substantially rectangular shape thus allow for slight deviations in the position of the slider relative to the recession 16, whilst enabling the head 2 to securely clamp the slider.

As is visible in FIGS. 4*a* and 4*b*, the upper jaw 6 comprises an upper surface 15*a* and a lower surface 15*b* connected to each other by a first side and a second side 15*c*, 15*d*, wherein the first side 15*c* joins the second side 15*d* at an edge; and wherein the edge is the first outer end 6*a* of the upper jaw.

A zipper has a chain and a slider that runs along the chain. The chain itself is made up out of two rows of elements, such as teeth or coil. The elements of one row of elements are able to interlock with the elements of the other row of elements. A slider runs along the chain and can join or separate the elements of each row, depending on the direction wherein the slider runs. Zippers of postal bags often comprise sheeting made of flexible fabric that covers both rows of elements and thus the chain of the zipper. This sheeting consists of two separate sheets, one for each row, abutting each other at one of their edges overlaying the rows of elements. The sheeting protects the zipper and prevents debris from becoming lodged between the rows of elements. The edge 17 of the upper jaw 6 is able to effectively separate both sheets at a location near the slider. As such, sheeting is not inadvertently clamped between the upper and lower jaw 6, 7 of head 2, which would hinder movement of the head 2 and the clamped slider in a direction along the length of the zipper.

As shown in FIGS. 4*a* and 4*b*, the edge 17 is at least partly chamfered. It comprises a first chamfered part 17*a*, a second chamfered part 17*b*, and a non-chamfered intermediate part 17*c* between the first chamfered part 17*a* and the second chamfered part 17*b*. It was found that these chamfered parts 17*a*, 17*b* of the edge 17 not only separate the sheeting effectively, but also prevent the upper jaw 6 from getting stuck and potentially tearing the sheeting or other parts of the bag or zipper.

Referring now to FIGS. 5*a* and 5*b*, showing the lower jaw 7 from the embodiment of the head 2 shown in FIGS. 3*a*-3*c*. The lower jaw 7 comprises an inner sprocket 10*a* that can interact with a complementary inner sprocket 10*a*' of the arm 3, enabling pivoting of the lower jaw 7 with respect to the arm 3. The lower jaw 7 has a rounded tip 18 that bends slightly downward away from the lower surface 15*b* of the upper jaw and is tapered towards its outer end 18*a*. The rounded tip 18 prevents bags from getting stuck to the tip and functions as a distancing element. In operation, the tip 18 of the lower jaw 7 is inserted in the bag below the slider. The tip 18 subsequently reaches a terminal position wherein it is pressed against the inside of the bag near the bottom stop of the zipper, preventing the head 2 from moving any further. At this position, the jaws 6, 7 of the head 2 are closed and it is ensured that the slider is located somewhere between both jaws 6, 7, either at a position which is located near the open end 16*b* of the recession 16 or at a location which is more close to the curved side 16*a* of the recession.

The recession 16 as shown in FIG. 4*b* has a depth of approximately 5 mm. Preferably this depth ranges between 1 to 10 mm, such as between 2 to 9 mm, more preferably between 3 to 8 mm, and most preferably between 4 to 6 mm. Such a depth ensures that the slider is secured within the recession 16 by the force enacted by the upper jaw 6 in a direction towards the lower jaw 7. The width of the recession 16 can be approximately 26 mm and its length approximately 34 mm, depending on the dimensions of the slider.

Figure 6:
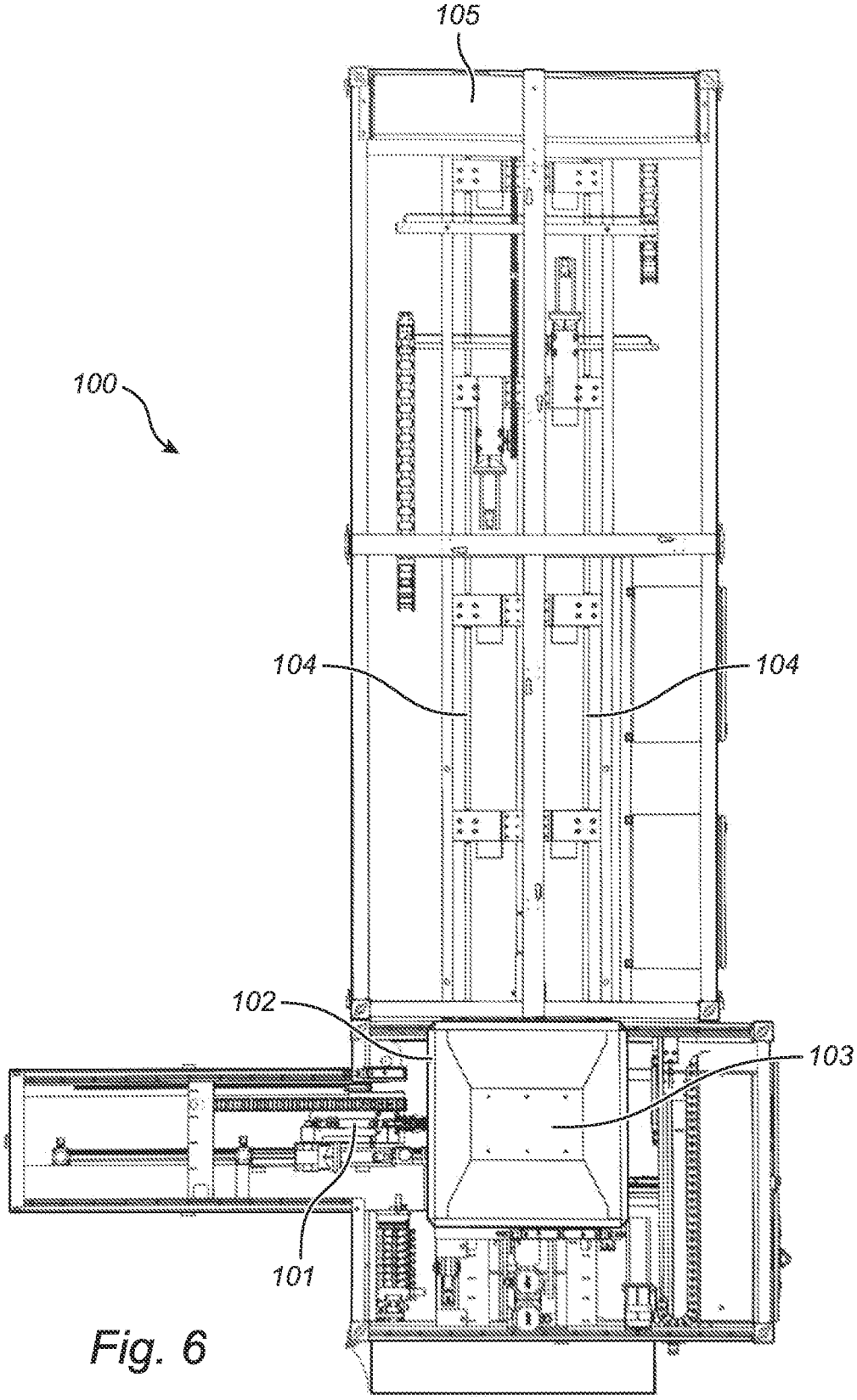
FIG. 6 shows a top view of an embodiment of a closing system according to the invention.

Referring now to FIG. 6, an embodiment of a closing system 100 for closing a postal bag comprising a zipper is depicted in a top view. Postal bags comprising zippers are fed into the closing system 100 and transported via a rail 104 towards a filling area 102. A hopper 103 is provided at a top side of the closing system 100, above the filling area. In the filling area 102, the postal bags are first opened via a bag opener (not shown) comprising a plurality of suction cups for attaching to at least one ring structure of the bag. The ring structure can be a simple metal ring.

The postal bags that are suitable to use in the closing system 100 as shown in FIG. 6 contain four rings, two on either side of the bag. The rings are positioned such that two through holes are formed. The bags can be hung on a set of rails 104 or pins that extend through these holes. As such, each postal bag is hung on the rails 104 and slidable thereon along the rails 104. A transport mechanism transports bags that are hung on the rails 104 from an entrance 105 of the closing system to the filling area 102 over the rails 104.

At the filling area 102, five suction cups of the bag opener engage each ring and a vacuum is applied by a vacuum module (not shown) The vacuum module is located near the suction cups and connected thereto via air hoses. The vacuum module is located within just a few centimetres of the suction cups, resulting in a notable decrease in power required to achieve vacuum. Once the four groups of five suction cups have engaged the four rings on the bags, the bag opener (not shown) pulls the two pairs of rings in opposite directions, thereby opening the bag.

The bag is subsequently filled with postal packages via the hopper 103. When the bag is filled, the clamping device, as shown in FIG. 1 is positioned such that the slider of the zipper (not shown) can be securely grabbed between the upper and lower jaw of the head. In the filling area 102, a gripping arm (not shown) grabs the bag on one side. When both clamping device 101 and gripping arm are secured, the gripping arm and clamping device 101 move in opposite directions parallel to the zipper to close the zipper. It is possible that the clamping device 101 remains at its position and that the gripping arm moves away from the clamping device 101 to create this movement.

It will be clear that the invention is not limited to the exemplary embodiments which are illustrated and described here, but that countless variants are possible within the framework of the attached claims, which will be obvious to the person skilled in the art. In this case, it is conceivable for different inventive concepts and/or technical measures of the above-described variant embodiments to be completely or partly combined without departing from the inventive idea described in the attached claims.

The verb 'comprise' and its conjugations as used in this patent document are understood to mean not only 'comprise', but to also include the expressions 'contain', 'substantially contain', 'formed by' and conjugations thereof.

The invention claimed is:

1. A clamping device for clamping at least part of a zipper, comprising:

a base, a head comprising an upper jaw movably connected to a lower jaw, an arm at one end pivotably connected to the base and at another opposite end pivotably connected to the head; and at least one driving means suitable for pivoting the head with respect to the arm;

wherein the upper jaw comprises a recession for accommodating at least part of a slider of the zipper;

wherein the head is movable from an open position, wherein the upper jaw and the lower jaw are spaced apart, to a closed position, wherein a cavity is formed by the recession and the lower jaw;

wherein the slider is securable within the cavity; and wherein the base comprises a motor for arranging to pivot the arm with respect to the base.

2. The clamping device according to claim 1, wherein the at least one driving means comprises a first hydraulic piston and a second hydraulic piston, wherein the first hydraulic piston is arranged to pivot the head with respect to the arm and wherein the second hydraulic piston is arranged for moving the head back and forth between the open position and the closed position.

3. The clamping device according to claim 1, wherein the upper jaw is tapered.

4. The clamping device according to claim 1, wherein the upper jaw comprises an outer edge running in a direction from the lower jaw to the upper jaw; wherein the outer edge is at least partly chamfered.

5. The clamping device according to claim 4, wherein the outer edge comprises a first chamfered part, a second chamfered part, and an intermediate part between the first chamfered part and the second chamfered part that is not chamfered.

6. The clamping device according to claim 5, wherein the first chamfered part is a corner chamfered part and/or wherein the second chamfered part is a corner chamfered part.

7. The clamping device according to claim 1, wherein the lower jaw has a rounded tip.

8. The clamping device according to claim 1, wherein the recession has a depth between 1 to 10 mm.

9. A closing system, comprising:

the clamping device according to claim 1; and a gripping arm for gripping a bag comprising a zipper;

wherein the clamping device and the gripping arm are movable in opposite directions along the length of the zipper.

10. The closing system according to claim 9, comprising a bag opener for opening the bag, wherein the bag opener comprises a plurality of suction cups for attaching the bag.

11. A method for closing a bag comprising a zipper, comprising:

opening the bag;

clamping a slider of the zipper with the clamping device according to claim 1;

gripping the bag with a gripping device; and moving the gripping device and the clamping device in opposite directions along the length of the zipper to close the bag.

12. The method according to claim 11, wherein the step of opening the bag comprises attaching a first plurality of suction cups to the bag on one side of the bag and attaching a second plurality of suction cups to the bag on an opposite side of the bag; and pulling the first plurality of suction cups and the second plurality of suction cups away from each other in opposite directions.

13. A head for a clamping device comprising:

an upper jaw movably connected to a lower jaw, wherein the upper jaw comprises a recession for accommodating at least part of a slider of the zipper;

wherein the head is movable from an open position, wherein the upper jaw and the lower jaw are spaced apart, to a closed position, wherein a cavity is formed by the recession and the lower jaw; and wherein the slider is securable within the cavity; and wherein the recession has a depth between 1 to 10 mm.

14. The head according to claim 13, wherein the upper jaw is tapered and comprises an outer edge running in a direction from the lower jaw to the upper jaw; wherein the outer edge is at least partly chamfered.

* * * * *